United States Patent [19]

Bersani

[11] Patent Number: 4,741,449

[45] Date of Patent: May 3, 1988

[54] CONTAINER SHAPED STRUCTURAL ELEMENT AND STRUCTURE OBTAINED FROM A PLURALITY OF COMPONENTS FROM SUCH CONTAINERS

[75] Inventor: Pier Bersani, Brussels, Belgium

[73] Assignee: Parteurosa S.A., Luxembourg, Luxembourg

[21] Appl. No.: 504,591

[22] Filed: Jun. 16, 1983

Related U.S. Application Data

[63] Continuation of Ser. No. 251,044, Apr. 6, 1981.

[30] Foreign Application Priority Data

Apr. 15, 1980 [BE] Belgium ..... PVO/200.228

[51] Int. Cl.[4] ..... B65D 88/00

[52] U.S. Cl. ..... 220/1.5; 220/4 F; 24/287

[58] Field of Search ..... 220/1.5, 232, 4 R, 4 F; 24/287

[56] References Cited

U.S. PATENT DOCUMENTS

| | | | |
|---|---|---|---|
| 90,998 | 6/1869 | D'Heureuse | 411/400 |
| 2,963,310 | 12/1960 | Abolins . | |
| 3,004,772 | 10/1961 | Bohlen et al. . | |
| 3,042,227 | 7/1962 | Tantlinger . | |
| 3,071,277 | 1/1963 | Olson et al. . | |
| 3,221,921 | 12/1965 | Silverman | 220/232 |
| 3,374,915 | 3/1968 | Verhein et al. . | |
| 3,561,633 | 2/1971 | Morrison | 220/1.5 |
| 3,691,595 | 9/1972 | Backteman et al. | 220/1.5 X |
| 3,807,581 | 4/1974 | Nichols . | |
| 4,049,149 | 9/1977 | Durenec | 220/1.5 |
| 4,171,059 | 10/1979 | Heller et al. . | |
| 4,212,251 | 7/1980 | DiMartino | 24/287 |

FOREIGN PATENT DOCUMENTS

| | | |
|---|---|---|
| 1545902 | 9/1975 | Fed. Rep. of Germany . |
| 1580273 | 9/1969 | France . |
| 12455 | 1/1980 | Japan . |
| 7600978 | 8/1976 | Netherlands . |
| 303050 | 12/1928 | United Kingdom . |
| 362918 | 11/1931 | United Kingdom . |
| 647965 | 12/1950 | United Kingdom . |
| 706123 | 3/1954 | United Kingdom . |
| 1163354 | 9/1969 | United Kingdom . |
| 1217334 | 12/1970 | United Kingdom . |
| 1230416 | 5/1971 | United Kingdom . |
| 1311517 | 3/1973 | United Kingdom . |
| 1451627 | 10/1976 | United Kingdom . |

OTHER PUBLICATIONS

Bureau International des Containers, Information Card 560, 15.021, Jun. 1966.

*Primary Examiner*—Henry J. Recla
*Assistant Examiner*—David Voorhees
*Attorney, Agent, or Firm*—Spencer & Frank

[57] ABSTRACT

A container-shaped structural element which comprises first and second unitary structural components in combination with frame elements. Each of the structural components includes a surface member, corner members secured to corners of the surface member and connecting members secured to the surface members. First fastening means are provided in each of the corner members and second fastening means in each of the connecting members. The frame elements are interposed between respective connecting members, and are provided with third fastening means in their ends which cooperate with the second fastening means in the connecting members. Corresponding second and third fastening means are mutually connectable and releasable independently of the other second and third fastening means.

27 Claims, 4 Drawing Sheets

CONTAINER SHAPED STRUCTURAL ELEMENT AND STRUCTURE OBTAINED FROM A PLURALITY OF COMPONENTS FROM SUCH CONTAINERS

This application is a continuation of application Ser. No. 06/251,044, filed. Apr. 6, 1981.

BACKGROUND OF THE INVENTION

This invention relates to a container-shaped structural element, which comprises a top surface, a bottom surface, vertical front, back and side surfaces, as well as a carrying frame, and to a structure obtained from a plurality of components from such containers.

Containers are known the sizes of which are generally standardized and which are mainly used to convey various goods, for instance industrial equipment goods.

In this particular case, when the container has reached the destination thereof, it is required to remove the equipment goods therefrom, to assemble same in the suitable location, and to connect and test the goods, which brings high costs and requires much manpower, which may not be easy when the assembly location lies for example in a low-industrialization country.

Containers are known the various walls of which are hingedly connected together, notably by means of hinges, to make it possible to obtain by swinging some container panels about the rotation axis thereof and possibly assembling a plurality of such containers, structures such as buildings, workplaces, halls, etc. It is possible with such containers, to mount before the container departure, the equipment goods to be conveyed, on that panel which is intended therefor in the structure to be assembled, and to connect said goods firmly as well as to subject same to preliminary tests (see for instance U K patent application No. 79 179960 dated May 23, 1979).

Such containers have however the drawback that the wall elements thereof are always connected together and thus that the assembly and connecting of the equipment goods has to be made on the complete container, which is very cumbersome and raises problems of available space. On the other hand, in that case where said containers are to be returned empty, the containers would still be bulky and thus result also in a loss of space.

SUMMARY OF THE INVENTION

An object of this invention is to design a container-shaped structural element which solves all the above-defined problems, while still retaining the capacity of obtaining structures from the components of said structural element and satisfying the size standards set for the containers, thus notably allowing said containers to be conveyed by ship.

According to the invention, there is provided a structural element as defined hereinabove. which comprises first and second unitary structural components. Each structural component includes a surface member, corner members secured to corners of the surface member and being provided with a first fastening means therein, and connecting members secured to the surface member and being provided with second fastening means therein. Frame elements having third fastening means in the ends thereof are interposed between respective connecting members, the third fastening means cooperating with the second fastening means to couple the frame elements to the respective connecting members. Corresponding second and third fastening means are mutually connectable and releasable independently of the other second and third fastening means.

In an advantageous embodiment of the invention, the third fastening means are arranged on removable insert elements separate from the frame elements.

In a further embodiment of the invention, the frame elements have in each location opposite one of the connecting members, fourth fastening means, and said inert elements are provided on the side thereof opposite that side provided with the third fastening means, with fifth fastening means for cooperating with the fourth fastening means from the frame elements.

As used herein the phrase "container-shaped structural element" means an element the components of which are used to build-up structures such as workplaces, halls, buildings and particularly production units to be delivered "ready to run", said structural element being conveyable in such a form the size of which is the standardized size for containers.

In an embodiment of the invention, such structures have as floor, ceiling or side walls, a plurality of such structural elements in container shape, which are aligned and retained together in the corners thereof, by means of said first and/or second fastening means, by small plates covering the corners from two, three or four wall elements to be assembled and having facing each said first and/or second fastening means, sixth fastening means which can cooperate therewith.

In an advantageous embodiment of the invention, the structure comprises at least one frame element from said container-shaped structural element, which is again mounted on any one from said first, second and/or fifth fastening means from the structure, by the fastening means which are provided on said frame elements, with or without insert element.

BRIEF DESCRIPTION OF THE DRAWINGS

Other detail and features of the invention will stand out from the following description, given by way of non limitative example and with reference to the accompanying drawings, in which.

DESCRIPTION OF THE PREFERRED EMBODIMENT

In the various figures, the same references pertain to identical or similar elements.

Figure 1:
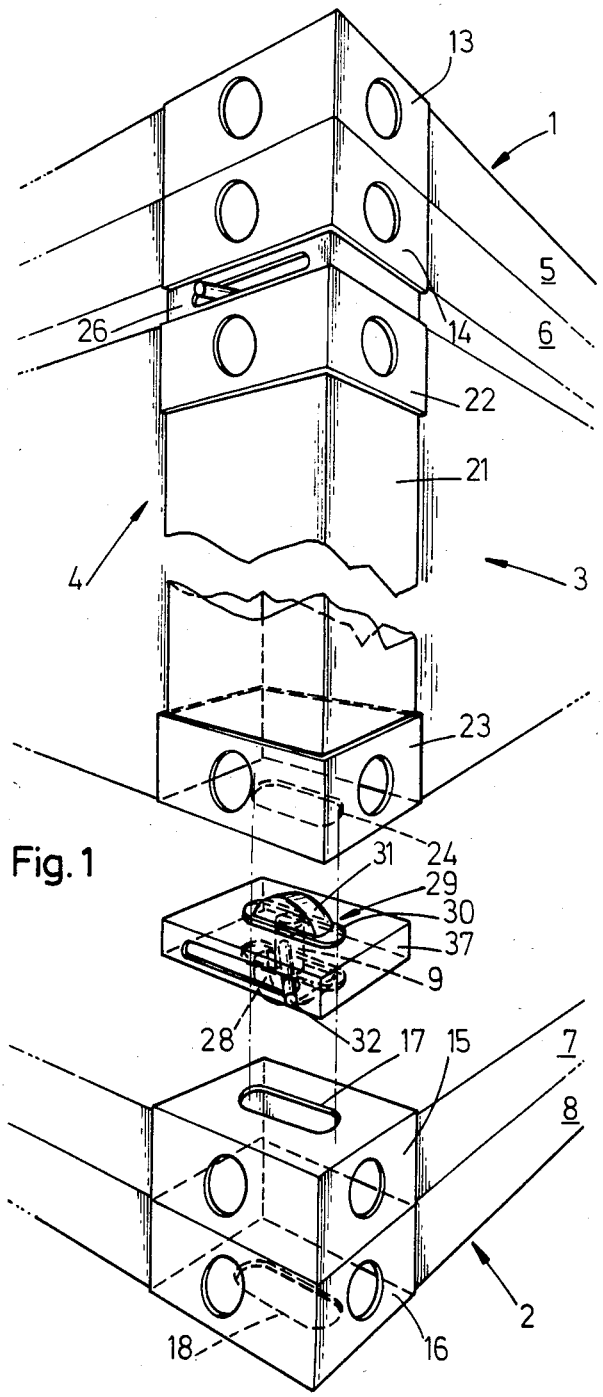
FIG. 1 is a perspective view, partly exploded, from the corner of a container-shaped structural element according to one embodiment of the invention.

The container as shown partly in FIG. 1, comprises a top wall 1 and a bottom wall 2 comprising first and second spaced unitary structural components. The container further includes four vertical walls among which the two walls shown bear reference numerals 3 and 4.

In the example as shown, the top and bottom walls are formed by similar superimposed panels or surface members 5,6 and 7,8 respectively.

Each panel is provided at each corner thereof with hollow prism-shaped parts 13, 14, 15 and 16, the one base in parallel relationship with the large surfaces from the panels, has an oblong-shaped opening as shown by the openings 17, 18 which are the only ones to be shown. As it may be seen, boyth those panels 5,6 and 7,8 which form each top wall 1 or bottom wall 2 of the container, are so arranged relative to one another in a reversed position that the oblong-shaped openings face the one on the outside and the other one on the inside of the container. In this position, the panels may be connected together by any suitable means, for instance by welding.

The container as shown in FIG. 1 further comprises as frame elements, four uprights with but upright 21 being shown. Said upright in this embodiment, is provided at each end thereof, with hollow prism- shaped parts 22 and 23 which are similar to those parts arranged at the panel corners and the oblong openings of which, such as the opening 24 which is the only one to be shown, lie on the front base of said prisms, which thus lies opposite the prism-like parts 14 and 15 respectively, which will be called connecting elements or members. Said end parts 22 and 23 are fixedly connected to the ends of upright 21.

Between said upright 21 and each said connecting prism-shaped elements 14 and 15 is arranged an insert element 26,27 respectively, which is provided on both front surfaces thereof with projections such as the projections 28, 29 respectively which are the only ones to be shown. Said projections can cooperate with the oblong openings 17, 24 from the connecting elements 14 and 15, and the end parts 22 and 23 to fasten the insert elements both to said upright 21 and to the connecting elements from the top wall 1 and bottom wall 2. Each projection comprises a base portion 30 fixedly connected to the insert element and with a shape identical to that oblong opening into which said projection is to be fitted, as well as an apex portion 31 which is swingable between a position where the projection engages the opening (as shown in the exploded part of FIG. 1), wherein said portion is aligned with base portion 30, and a position where said projection is made fast into the opening, wherein said apex portion 31 lies at right angle to the lengthwise axis of the oblong opening, by projecting beyond the edges thereof (position as shown in the broken-away part of FIG. 3). In the embodiment as shown, the apex portions 31 of both projections 28 and 29 from one and the same insert element are so arranged as to be swingable about one and the same swinging axis 9. Said axis is connected in any suitable way inside said insert element, to a lever arm 32 which is reachable from outside or inside the container and which allows control of the swinging of both said apex portions at the same time, for assembling or dismantling the various container walls.

It is advantageously provided that the total height of both corner elements or members 13 and 16, both connecting elements or members 14 and 15, both insert elements 26, 27, and upright 21 provided with both ends parts 22, 23, be equal to the height of the containers as required by international standards.

Figure 2:
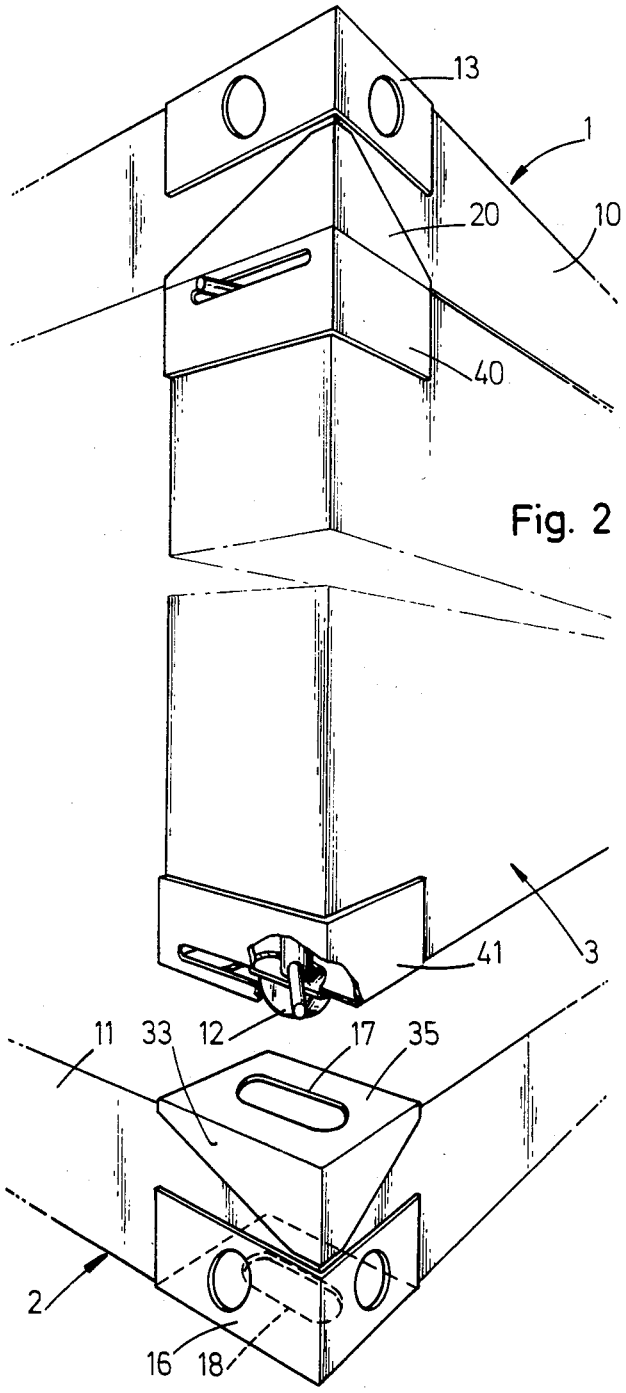
FIG. 2 is a perspective view, partly exploded, from the corner of another embodiment of the invention.

In an embodiment as shown in FIG. 2, the top and bottom walls 1 and 2 are each formed by a single panel 10 and 11 respectively. The corners of each panel are provided with corner elements 13 and 16, but in the example as shown, both connecting elements are formed by two trihedral-shaped parts 20 and 33. Two sides from each trihedral part are arranged in parallel relationship with the vertical planes. The third side from each trihedral part 20,33, side 35 only being shown, is arranged against that side of walls 1, 2 respectively, which faces inside the container and it is provided with an oblong opening, opening 17 only being shown.

The one frame element of the container is in the embodiment as shown in FIG. 2, the wall 3 itself which is fitted in the corners thereof, with coupling elements 40 and 41 fixedly connected to said wall. Said connecting elements are each provided on the outer front side thereof with a projection such as projection 12, the shape and function of which are identical to the projections 28 or 31 in FIG. 1 and which thus allow wall 3 to be fastened to the top wall 1 and bottom wall 2, or to remove same therefrom.

Figure 5:
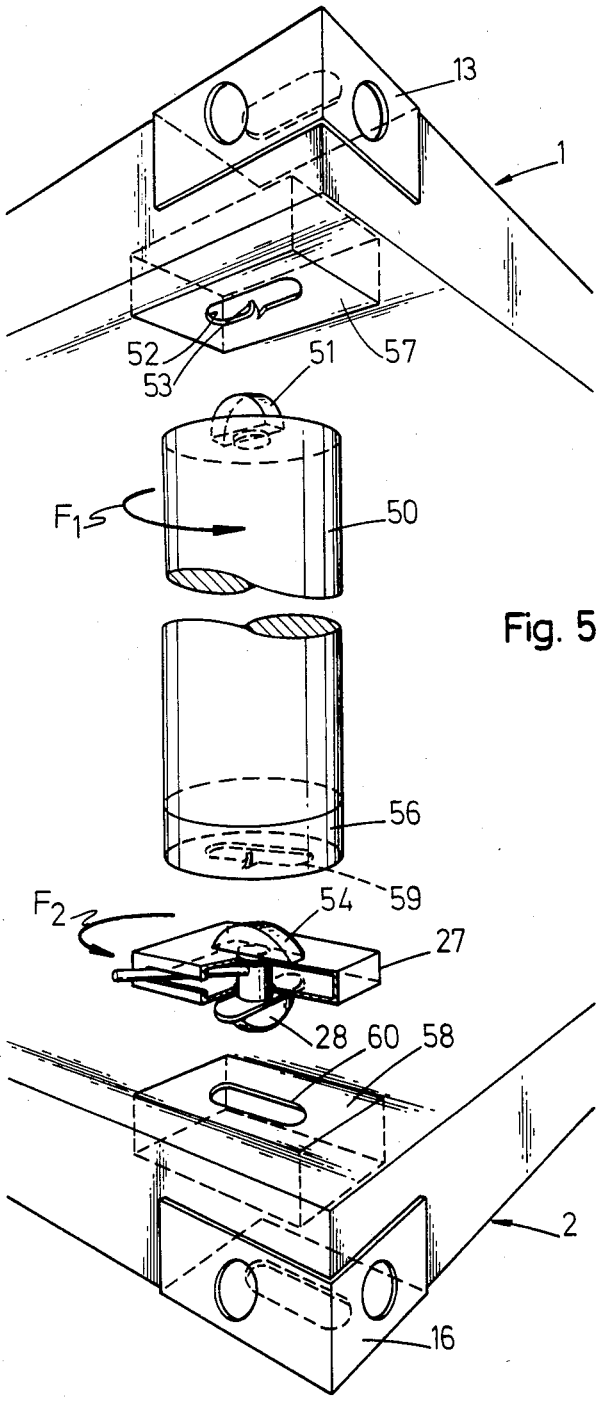
FIG. 5 is an exploded perspective view showing modifications of container-shaped structural element according to the invention.

FIG. 5 shows top and bottom walls 1, 2 identical to those walls 1, 2 as shown in FIG. 2, with similar corner elements 13 and 16. The frame elements are uprights with circle-shaped cross-section, among which but upright 50 is shown. As it appears from this figure, said upright 50 and connecting elements 57 and 58 are not arranged in the corners of panels 1 and 2, but rather they are recessed which is for instance advantageous to provide an overhang.

In the modification as shown in the top part of FIG. 5, a fixed projection 51 is provided on the top end of upright 50. After fitting said projection 51 in the oblong operation 52 of connecting element 57, said upright 50 is rotated over an angle of about 90° along the direction of arrow F1. In such a position, upright 50 is retained by a locking stop 53 for example.

In the modification as shown in the bottom part of FIG. 5, there is provided an insert element 27 the lower projection 28 of which is identical to the projection as provided for in FIG. 1, but the upper projection 54 of which is fixedly connected to said insert element. Before fitting-in, both projections are mutually arranged in planes at right angle to one another. Projection 54 is first fitted into the oblong opening 59 in the end part 56 from frame element 50, then said insert element 27 is rotated over 90° along the direction of arrow F2, which aligns projection 28 with oblong opeing 60 in connecting element 58. After fitting-in, the rotatable portion from projection 28 is rotated over 90° by means of control lever 32.

FIG. 2 shows an example for using container walls to make a structure in accordance with another aspect of the invention. Two top and/or bottom walls, in the example as shown wall 1 and wall 2 are assembled to form the floor of a workplace. To fasten said walls together, there have been provided small plates 44 which can cover at least two and possibly four corner elements in square formation. The small plate has on that side thereof removed from the walls it will be fastened to, at least two and possibly four projections 25 the shape and function of which are identical to projections 12, 28 or 29. Said projections 25 are each controlled by a lever 42 and cooperate with those oblong openings which are provided in those sides opposite the connecting and/or corner elements, from the wall to be assembled.

Figure 4:
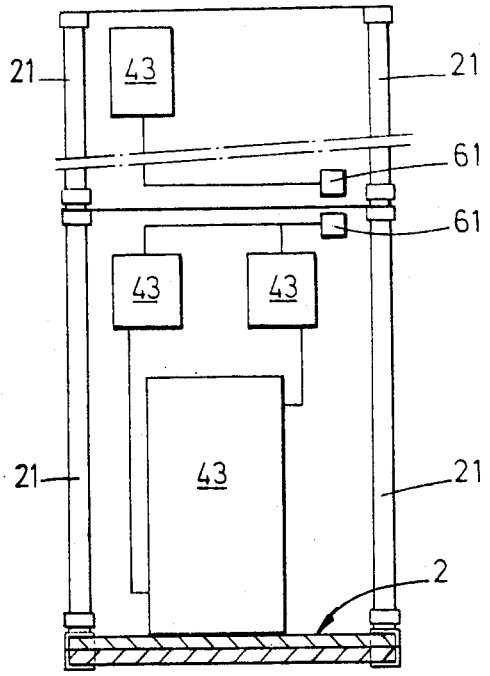
FIG. 4 is a front view of two side walls which are assembled on top of one another on a floor as shown in FIG. 3, equipment goods already being mounted on said side walls and floor.

FIG. 4 shows the assembly of two container side walls on top of one another, the uprights 21 thereof lying on top of one another and being fastened to one another by an insert element which is identical to said insert elements 26 and 27. As it may be seen, equipment goods 43 are mounted on the panels and floor, and they are connected. Moreover it is clear from this figure that to assemble equipment goods 43 thereon, only the panels and floor have been sent to the workplace and not the complete container. Manifolds 61 connected to said goods 43 are provided on each panel or floor for connecting the assembly in situ.

It must be understood that the invention is in no way limited to the above embodiments and that many changes may be made therein without departing from the scope of the invention as defined in the appended claims.

For instance, fastening projections may be provided on the connecting elements for the top and bottom walls, and oblong openings may be provided at the upright ends.

Any other suitable fastening means might be provided for, as long as said means are easy to use and allow to comply with the conveying standards required from containers.

Such fastening might also only be provided for some container walls, other walls remaining fixedly or hingedly connected.

It would also be possible to provide between the elements to be assembled, anti-friction plates or even anti-friction coatings between the various elements provided with projections and openings.

Assembly plates might also be provided with non-rotatable projections in that case where the fundations for the building to be erected have been made accurately.

It is also preferably provided that the connecting elements 14 and 15, 20 and 33, or 57 and 58 respectively have the inner side thereof so arranged as to be flush relative to the inner sides of panels 1 and 2, in such a way that at the moment where the structure is assembled, there will not be any uneveness in the floor level.

It is clear that the corner elements 13 and 16 will preferably be comprised of standard lugs complying with the international standards and located in space according to such international standards.

Figure 3:
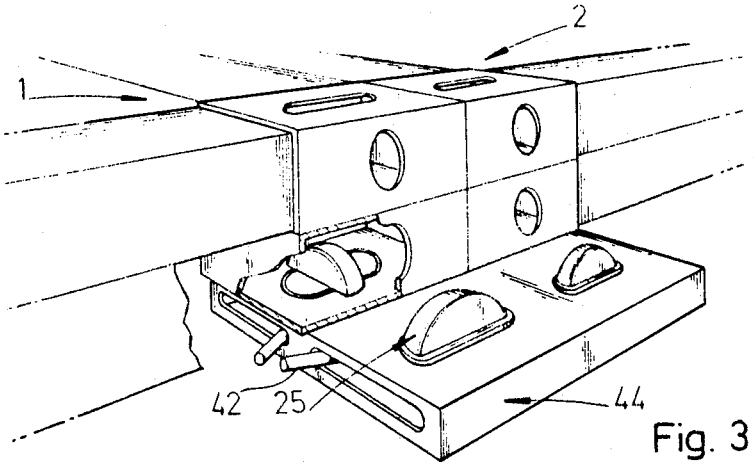
FIG. 3 is a perspective view of two top and/or bottom walls as assembled to form for example, a floor in a structure according to the invention.

It is also possible to provide small plates 44 not only for the assembly as shown in FIG. 3, of a plurality of walls, but also for the assembly of a plurality of containers side by side, the adjacent walls from two assembled containers may then be removed.

Figure 6:
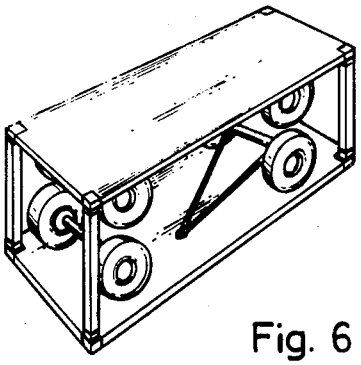
FIG. 6 is a perspective view showing a particular use of a structure according to the invention.

It is also possible to provide inside the container, instead of mounting equipment goods 43 on the one container wall, the assembly of a trailer frame, wheels and a coupling hook on the one container wall, or even the assembly of such an unit on two opposite walls of the container, as shown in FIG. 6. After dismantling, there are thus obtained two trailing platforms on which another container can be secured.

I claim:

1. A container-shaped structural element, comprising:

(1) first and second spaced unitary structural components, each including (a) a surface member having outer and inner parallel faces and a plurality of corners;

(b) corner members secured to corners of said surface member, each of said corner members having a face substantially parallel to the plane of the outer face of said surface member and having a first fastening means therein; and (c) connecting members secured to said surface member, each of said connecting members having a face substantially parallel to the plane of the inner face of said surface member and having a second fastening means therein, and (2) frame elements interposed between respective connecting members of said first and second structural components, each of said frame elements having first and second opposing ends and third fastening means in said first and second opposing ends, respectively, the third fastening means in the first and second ends of said frame element cooperating with the second fastening means in respective connecting members of said first and second structural components to couple said frame element thereto, each corresponding second and third fastening means being mutually connectable and releasable independently of the other second and third fastening means.

2. A structural element as defined in claim 1, wherein said second fastening means is substantially identical to said first fastening means.

3. A structural element as defined in claim 1, wherein each said corner member is a hollow prism-like part which has a base facing outside the container which constitutes said outside facing side and said third fastening means is an oblong opening provided in said base.

4. A structural element as defined in claim 1, and further comprising a plurality of plates each having attaching means for cooperating with at least one of said first and second fastening means for aligning and retaining together a plurality of said container-shaped structural elements.

5. A structural element as defined in claim 4, wherein at least one of said first and second fastening means is an oblong opening.

6. A structural element as defined in claim 1, further comprising vertical walls connecting together said frame elements.

7. A structural element as defined in claim 1, wherein each said connecting member has the shape of a hollow prism with a base which constitutes the face substantially parallel to the plane of the inner face of said surface member.

8. A structural element as defined in claim 1, wherein each said connecting member has the shape of a trihedral with a base which constitutes the face substantially parallel to the plane of the inner face of said surface member.

9. A structural element as defined in claim 1, wherein said connecting members are hollow, each said second fastening means includes an oblong opening and each said third fastening means includes a projection which is fittable into a respective one of said oblong openings and is releasably fastenable inside the associated connecting member.

10. A structural element as defined in claim 9, wherein each said projection includes: a fixed base portion with a shape corresponding to said oblong opening of the corresponding connecting member; an apex portion having a length greater than the smallest diameter of said oblong opening, said apex portion being swingable between a first position in which said length of said apex portion is aligned lengthwise with said base portion for insertion into said oblong opening and a second position in which said length of said apex portion lies in a plane at right angles to the lengthwise axis of said oblong opening, wherein when said apex portion is in said second position said apex portion projects beyond said oblong opening and forms a releasable connection with said connecting member; and control means coupled to said swinging apex portion of said projection for controlling the position thereof.

11. A structural element as defined in claim 9, wherein each said projection is in part fixedly connected to its associated frame element, and said associated frame element has an axis and is arranged to be rotatable about said axis over an angle of 90° after fitting its projection into the corresponding oblong opening.

12. A structural element as defined in claim 1, further including a plurality of removable insert elements, wherein said third fastening means is arranged on a respective one of said insert element and said insert elements are each removably connected with a respective one of said frame elements.

13. A structural element as defined in claim 12, wherein said frame elements include fourth fastening means in each location opposite one of said connecting members, and each said insert element includes fifth fastening means on the side thereof opposite the side provided with said third fastening means for cooperating with said fourth fastening means.

14. A structural element as defined in claim 13, wherein said frame elements include a hollow element at each location opposite one of said connecting members, and each said hollow element has an outer front side facing toward said opposite connecting members on which outer front side is disposed an oblong opening which constitutes said fourth fastening means.

15. A structural element as defined in claim 14, wherein said connecting elements are hollow elements.

16. A structural element as defined in claim 14, wherein each said fifth fastening means includes a projection which is fittable into its corresponding oblong opening in the hollow element of said frame element and is releasably fastenable thereto.

17. A structural element as defined in claim 16, wherein said third fastening means of each said insert element is formed by a projection substantially similar to the projection which constitutes said fifth fastening means, and which further comprises control means having a single lever connected inside each said insert element through said base portions for controlling the swinging portions of both opposite projections of, respectively, said third and fifth fastening means.

18. A structural element as defined in claim 16, wherein said projection is in part fixedly connected to its associated insert element and said associated insert element has an axis and is arranged to be rotatable about said axis over an angle of 90° after fitting its projection into the corresponding oblong opening.

19. A structural element as defined in claim 16, wherein each said projection includes: a fixed base portion with a shape similar to said oblong opening of the corresponding frame element; an apex portion having a length greater than the smallest diameter of said oblong opening, said apex portion being swingable between a first position in which the length of said apex portion is aligned lengthwise with said base portion and said projection may be inserted into said oblong opening and a second position in which said length of said apex portion lies in a plane at right angles to the lengthwise axis of said oblong opening, wherein when said apex portion is in said second position said apex portion projects beyond said oblong opening and forms a connection with the corresponding frame element; and control means coupled to said swinging portion of each said projection for controlling the position thereof.

20. A structural element as defined in claim 18, wherein said third fastening means is a projection which is fixedly connected to said insert element, and said insert element has an axis and is arranged to be rotatable about said axis over an angle of about 90° after fitting said fixedly connected projection inside the corresponding oblong opening.

21. A structural element as defined in claim 1, wherein said structural element is adapted to contain apparatus and the apparatus is fastened to at least one of said components.

22. A structural element as defined in claim 1, wherein said first and second components form top and bottom surfaces, respectively, and further comprising third, fourth, fifth and sixth components which form vertical front, back and side surfaces of said structural element, said carrying elements connecting all said components to form said structural element.

23. A structural element as defined in claim 22, wherein said structural element is adapted to contain apparatus and the apparatus is fastened to at least one of said components.

24. A structural element as defined in claim 1, wherein said structural components and frame elements are disassemblable and reassemblable via said fastening means to form a different arrangement of said structural components and frame elements.

25. A structural element as defined in claim 24, wherein at least one of said frame elements is, in reassembly, mounted on one of said structural components.

26. A structural element as defined in claim 12, wherein said structural components, frame elements and insert elements are disassemblable and reassemblable via said fastening means to form a different arrangement of said structural components, frame elements and insert elements.

27. A structural element as defined in claim 26, wherein at least one of said frame elements is, in reassembly, mounted on one of said structural components via one of said insert elements.

* * * * *